United States Patent [19]

Munks

[11] Patent Number: 4,550,686

[45] Date of Patent: Nov. 5, 1985

[54] ANIMAL SLING

[76] Inventor: R. Leonard Munks, 1143 W. March Point Rd., Anacortes, Wash. 98221

[21] Appl. No.: 560,595

[22] Filed: Dec. 12, 1983

[51] Int. Cl.[4] ..... A61D 3/00

[52] U.S. Cl. ..... 119/102

[58] Field of Search ..... 119/100, 101, 102

[56] References Cited

U.S. PATENT DOCUMENTS

| | | | |
|---|---|---|---|
| 48,225 | 6/1865 | Vogeli | 119/101 |
| 1,015,239 | 1/1912 | Miller | 119/102 |
| 1,277,052 | 8/1918 | Dunn | 119/102 |
| 1,366,178 | 1/1921 | Hatch | 119/102 |

*Primary Examiner*—Robert P. Swiatek

*Attorney, Agent, or Firm*—Kolisch, Hartwell & Dickinson

[57] ABSTRACT

A sling for a four-legged animal is provided. The sling includes the following components: a pair of longitudinally extending poles; a plurality of longitudinally spaced, transversely extending straps mounted between the poles; a centrally disposed web extending between adjacent transverse straps for supporting the belly of the animal; a pair of generally longitudinally extending leg straps mounted between the transverse straps, the transverse and longitudinal leg straps and the web collectively defining four leg openings and an udder/genital opening. The sling thus provides a means for safely raising an animal off the ground and for holding it there for extended periods without injury or discomfort to the animal.

11 Claims, 7 Drawing Figures

12
18
14
10
30
24
20
30b
18a
18b
18c
18d
18e
30a
52
51
53
46
26
55
50
32a
48
49
32b 70
68
72
16
54
56
64
66
60
58
62
10
14
12
18
30a
30b
46
26
32b
32a
30
22
24
52
20
51
53
48
55

22
72"
10
14
12
52
18
32a
32b
26
24
55
50
48
74
20
51
53

22
66"
14
10
12
52
18
51
53
18a
18b
18c
18d
18e
32a
32b
24
55
50
48
26
74
20

ANIMAL SLING

BACKGROUND OF THE INVENTION

1. Field of the Invention

This invention relates generally to an animal sling and more particularly to an animal sling adapted to permit a four-legged animal to be raised off the ground and to be held in such an elevated position for an extended period of time.

2. Discussion of the Prior Art

When livestock become ill or are injured, they sometimes seek relief by lying down on their sides. However, they often have trouble getting back up to a standing position and sometimes do not have the will to get up. When livestock remain in a downed position, it does not take very long before their legs begin to atrophy and other adverse effects begin to show.

Because of this problem, farmers must from time to time encourage or assist livestock in getting up from a downed position. Due to the size and weight of larger livestock such as cattle, there is very little one can do without power lifting equipment to assist an animal in getting up. Even with lifting equipment, there is not much that can be done because most such equipment is ill-suited for raising a downed animal to a standing position.

Because of this need, various types of lifts have been developed to assist the farmer. One such apparatus takes the form of a so-called hip-lifter, which comprises a simple clamp-like means which is tightened onto the hips of the animal, typically a cow or bull, and is then elevated by power means such as a front end loader, until the animal is raised sufficiently that it can stand.

The problem with hip-lifters is that they often result in the animal being bruised, and, if used for more than a very short period, can result in permanent injury to the animal. A wide canvas strap has been used in conjunction with a conventional hip-lifter to bear some of the weight of the animal and thereby reduce the possibility of bruising. However, this hip-lifter/canvas strap design still does not evenly distribute the weight of the animal, so it can similarly only be used for a relatively short period. Moreover, the animal is quite unstable and if it struggles, which often may be expected, it could fall from the hip-lifter. Also, the use of canvas or a similar nonporous material can result in discomfort to the animal if used for a prolonged period.

To overcome some of the drawbacks of conventional hip-lifters, a ring-like, inflatable lifter has been developed which is to be slipped around the downed animal and then inflated, thereby raising the animal off the ground. Like the hip-lifter, this does not provide any means for supporting the animal in a raised position for anything other than a very shorter time.

As mentioned above, the need exists for an apparatus for holding an animal in a raised position for a substantial period of time. There are several reasons why such a need exists. First, livestock and other animals often incur leg injuries which can only heal through rest. Unfortunately, if the animal attempts to rest in a downed position, atrophy of the other limbs and other related problem arise. By holding the animal off the ground during healing of the limb, such drawbacks are avoided. To be effective, however, such an apparatus must be able to hold the animal so that even if the animal struggles, it will not injure itself or fall from the support. It may also be desirable to hold the animal in position for other reasons, such as for mating or artificial insemination, for weighing the animal, for birthing purposes, for milking or for calf nursing. Under other circumstances it may be desirable to restrain an animal which is like to become uncontrollable. For example, a veal calf is typically never removed from its stall until time for slaughter. Such animals become extremely disturbed upon being removed from their stall for the first time, and could present problems without an effective means of restraint.

U.S. Pat. No. D.201,010 discloses an animal restraint which is apparently designed to be used with dogs. It appears to permit the dog to be raised off the ground by supporting its entire torso. One drawback with this design is that it is not in any way adjustable to accommodate animals of different size. Moreover, means is not provided for the udders or sex organs of the animal, which obviously are of substantial size in larger livestock. Also, because narrow straps appear to hold the entire weight of the animal, it is unlikely that the patented design could be used for an extended period of time without extreme discomfort to the animal. Yet another drawback is that the sex organs are apparently not exposed, so the apparatus is not usable for mating purposes.

It is an object of the present invention to provide an animal support which overcomes the drawbacks and limitations of the prior art proposals. More specifically, the present invention has the following as its objects: (1) to develop an animal sing which may be slid under downed livestock permit the livestock to be raised to an elevated position held there for a substantial period for time; (2) to provide an apparatus for supporting an animal while leaving the sex organs and udders exposed to prevent injury and to permit mating; (3) the development of means for restraining animals which may be usable during birthing, milking, nursing, artificial insemination, medical procedures, weighing, and similar activities; and (4) the provision of an animal sling which is adjustable to accommodate animals of widely differing sizes.

SUMMARY OF THE INVENTION

The present invention achieves the above objects by providing a sling for a four-legged animal which includes the following components: a pair of longitudinally extending poles; a plurality of longitudinally spaced, transversely extending straps mounted between the poles; centrally disposed web means extending between adjacent transverse straps for supporting the belly of the animal; a pair of generally longitudinally extending leg straps mounted between the transverse straps, the transverse and longitudinal leg straps and the web collectively defining four leg openings and an udder/genital opening.

The invention thus provides an animal sling which permits livestock or other large animals to be raised off the ground and held there for extended periods of time during which the animal can recover from injury or illness, can be mated or artificially inseminated, can be milked or nursed, can give birth or can be held for shipment or for other purposes, without resulting in discomfort or injury to the animal. Other objects, features and advantages of the present invention will become apparent upon reading the following detailed description in conjunction with the accompanying drawings.

DETAILED DESCRIPTION OF THE PREFERRED EMBODIMENT

Figure 1:
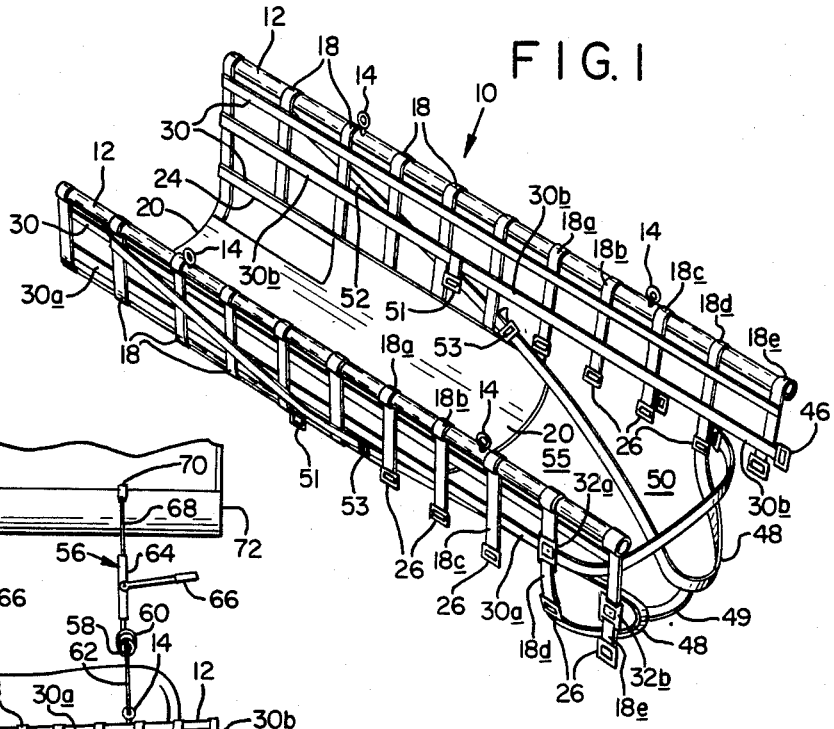
FIG. 1 is a perspective view of one embodiment of the present invention, showing the webbed and strapped structure mounted to a pair of support poles.

Construction of the Embodiment of FIGS. 1–6.

The objects of the present invention are particularly well-achieved when the invention takes the form of the embodiment depicted in FIGS. 1–6, the sling being generally indicated with the numeral 10. Sling 10 includes a pair of longitudinally extending poles 12 which are of sufficient length and weight to support the type of animal for which the sling is to be used. For cattle, it has been found that one and one half inch diameter galvanized steel pipe is appropriate. A pair of suitable eyelets 14 are mounted to each pole 12 to permit sling 10 to be mounted to a suitable power elevation means 16, to be described below.

A plurality of longitudinally spaced, transversely extending straps 18 are looped around and extend downwardly from each of the poles 12 to provide the primary weight support means for the sling. Many of the so-called transverse straps 18 extend all the way between the two support poles 12, but some of these straps are shorter in length and therefore do not interconnect across the poles. Transverse straps 18, as well as all other straps to be described below, are formed of a suitably strong material such as nylon, to give the sling sufficient strength. It is desirable that transverse straps 18 be removable from poles 12 for cleaning, repair or other purposes, but that they remain fixed in position with respect to the poles during use of the sling. For this reason, the end-most transverse straps are typically removably mounted to the poles 18 such as by bolting. For the purpose of simplification, this affixation means has not been depicted.

A web means or webbing 20 extends between adjacent transverse straps 18 at the forward end of the sling 10 along the underside thereof to provide support to the belly of the animal, such as a cow 22, which is to be lifted by sling 10. Webbing 20 is typically sewn to transverse straps 18, but may be fastened by other means as well. Webbing 20 is also typically formed of nylon in a pattern which is porous so that the skin of the animal 22 is permitted to breathe. This enhances the long-term feature of the invention by minimizing the possibility of damage to the hide of the animal, yet reduces the amount of pressure applied to particular points of the belly which could be a problem if transverse straps were used alone. Webbing 20 extends forwardly to the forward-most transverse strap as shown in FIG. 1 so that a substantial portion of the underside of the animal 22 is being held by the webbing. A pair of front leg openings 24 are defined by webbing 20 as a result of the narrowed configuration of the forward part of the webbing.

Figure 2:
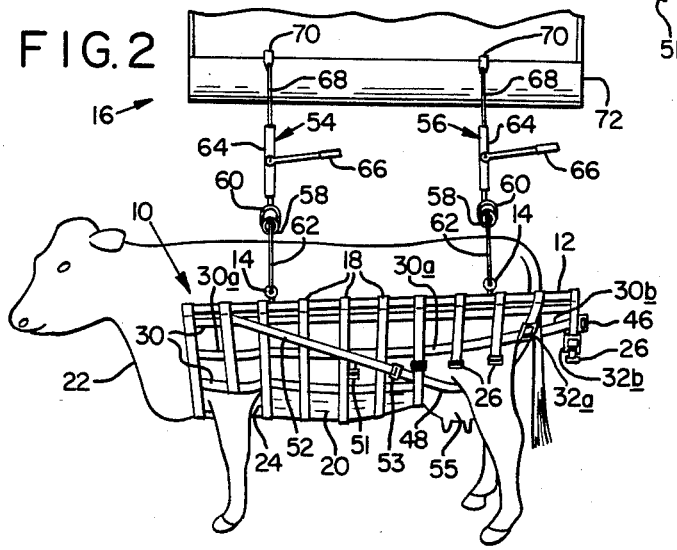
FIG. 2 is a side elevation view of the embodiment of FIG. 1, showing a medium sized cow being supported.

It is a desirable feature of the invention that some of the rear-most transverse straps 18 be relatively short in length, and terminate in slotted buckles, such as shown at 26 in FIGS. 1 and 2. In the depicted sling 10, five of the rear-most transverse straps have been identified with the designations 18*a, b, c, d* and *e* and will sometimes be referred to herein as leg support straps. Straps 18*a–e* are shown to terminate in downwardly extending slotted buckles 26 of conventional design, comprising a central member (not shown) around which transverse straps 18*a–e* are looped and sewn, thereby defining a pair of slots through which another strap may extend. Either all or some of these rear-most transverse straps 18*a–e* (leg support straps) include rearwardly extending slotted buckles 26, for purposes to be described below.

A plurality of longitudinally extending alignment straps 30 extend from end to end of sling 10, and are typically affixed such as by sewing to each of the transverse straps 18 so that the alignment of the transverse straps is maintained. As shown in FIGS. 1 and 2, the second alignment strap on one side of the sling 10 has been identified as 30*a* and is mounted to transverse straps 18*d* and *e* by a so-called pin buckle 32 which is shown in detail in FIGS. 5 and 6. Two pin buckles are provided, and are individually identified in FIGS. 1–4 as 32 *a* and *b*. Pin buckles 32 provide a means by which second alignment strap 30*a* may be affixed with respect to downwardly extending transverse straps 18 *d* and *e* to prevent relative sliding, but which permits the alignment straps to be removed from the buckle and from attachment to the transverse strap to permit the sling 10 to be adjusted to accommodate smaller animals. This will be explained in more detail below.

The structure of pin buckles 32 is relatively simple, comprising a single metal piece having a rigid pin 34 extending outwardly from a central member 36. The buckle includes a pair of slots 38 adjacent each end, to which two halves of a single transverse strap 18 may be mounted. Thus, pin buckle 32 becomes a permanent part of each of transverse straps 18*d* and *e*. A pair of side members 40 extend along the sides of pin buckle 32, thereby defining a pair of transverse slots 42 through which alignment strap 30*a* is adapted to extend. Alignment strap 30*a* is provided with spaced apertures 44, each of which is adapted to receive a pin 34 of a pin buckle 32. This engagement of aperture 44 with pin 34 prevents any sliding of alignment strap 30 through pin buckle 32.

The second alignment strap on the opposite side of the sling from alignment strap 30*a* has been designated with numeral 30*b*. Strap 30*b* terminates in a rearwardly extending slotted buckle 46 which permits engagement with the end of alignment strap 30*a* which extends around the rear of the animal 22.

A pair of generally rearwardly and longitudinally extending leg straps 48 extend between each of the rear legs of the animal 22 and the animal's udder or sex organs, thereby defining a pair of leg openings 50 and an udder/genital opening 55 and providing support to the rear portion of the animal. Each longitudinal leg strap 48 is preferably padded in some way where it contacts the animal's leg. This padding will normally be in the form of a soft rubber tube (not shown) or the like. At their forward end, each of the longitudinal leg straps 48 is mounted to a generally diagonally extending strap 52 which, in the depicted embodiment, extends across a substantial portion of the length of the sling 10, and is affixed such as by sewing to several of the transverse straps 18. The rear end of each of the longitudinal leg straps 48 is mounted to one of the downwardly extending slotted buckles 26 at the end of one of the transverse straps 18*a–e*. A cross piece 49 extends between the two longitudinal leg straps 48 to define the rearward end of the udder/genital opening 55.

As mentioned above, sling 10 is adapted to be used with power elevation means such as that shown generally at 16 to permit the animal 22 to be lifted off the ground. The power elevation means 16 may be of a wide variety of different conventional designs. It is often important to be able to accurately position the angulation of the animal 22 in a linear plane. This is particularly true where the sling is being used to promote healing of leg injuries where it is important that the amount of weight put on any one of the limbs be capable of being accurately controlled. To provide this capability, a pair of sling mounting members 54 and 56 is provided. The two sling mounting members 54 and 56 are of identical design, each including a transversely extending rod 58 having an upwardly extending loop 60 and a pair of downwardly extending oblong loops 62 which are adapted to engage eyelets 14 mounted to poles 12. A so-called come-a-long 64 is mounted to each of the upwardly extending loops 60 of transverse rods 58, each come-a-long 64 having an adjustment handle 66 extending therefrom. The come-a-longs 64 are conventional, each being a simple ratchet-type hand wrench which permits either end of the sling 10 to be slightly raised or lowered as necessary to accurately control the elevation of each end. In the depicted embodiment, each come-a-long 64 is mounted to a cable 68 having a hook 70 which may be mounted to the shovel 72 of a front-end loader or other means for providing a power lift capability.

Operation of the Embodiment of FIGS. 1–6

Figure 3:
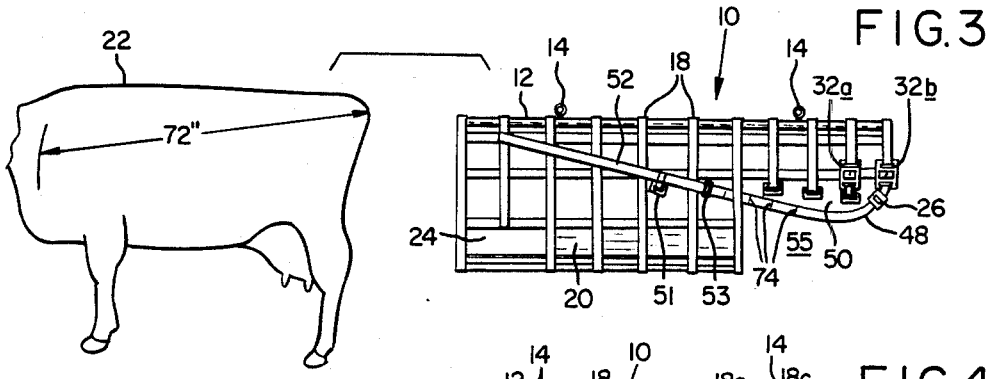
FIG. 3 is a side elevation, somewhat schematic view of the embodiment of FIG. 1, showing the straps adjusted to support a large cow.
Figure 4:
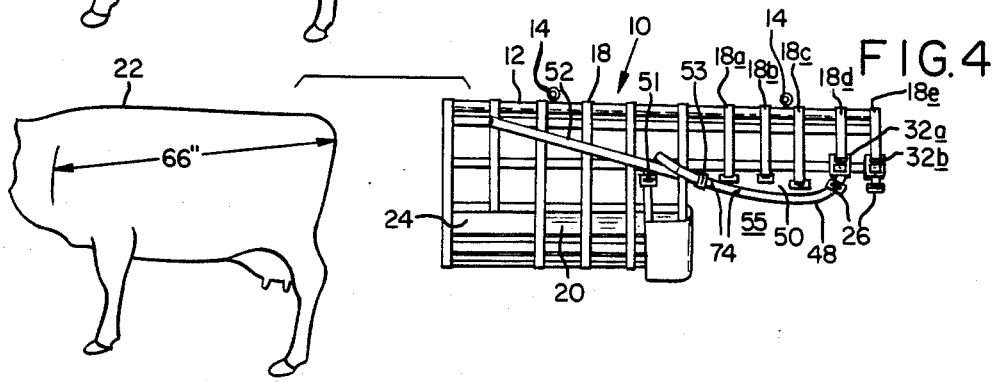
FIG. 4 is also a side elevation, somewhat schematic view showing the straps adjusted for a medium sized cow.
Figure 5:
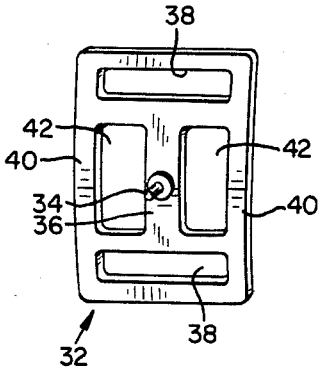
FIG. 5 is a perspective view of a buckle used with the embodiment of FIG. 1.
Figure 6:
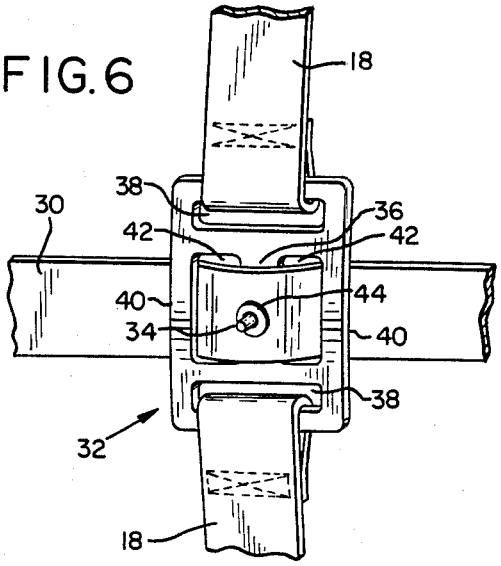
FIG. 6 is a frontal view of the buckle of FIG. 5 shown mounted to the strapping of the embodiment of FIG. 1.

To explain the operation or use of the depicted sling 10, it will be assumed that the animal 22 to be supported is ill or injured and is down on its side. Prior to putting the animal into the sling, the sling should be sized for the animal. To do this, the animal should be measured from its shoulder to its tail as shown in FIGS. 3 and 4. Markings 74 corresponding to this measurement are placed at spaced intervals along each of the longitudinal leg straps 48 so that the forward end of each of the longitudinal leg straps can be fastened to each of the diagonal straps 52 at slotted buckles 53 at the appropriate marking on that longitudinal leg strap. For larger animals, such as those measuring 72 inches from shoulder to tail, the back end of each of the longitudinal leg straps 48 is mounted to the downwardly extending slotted buckle 26 of the rear-most transverse strap 18*e*, as shown in FIG. 3. For this size animal, alignment strap 30*a* passes through both pin buckles 32*a* and *b*, and then across the rear of the animal and is connected to alignment strap 30*b* by rearwardly extending slotted buckle 46.

To accommodate a somewhat smaller cow, such as one measuring 66 inches from shoulder to tail, the back end of each of the longitudinal leg straps 48 is buckled to the second rear-most transverse strap 18*d* as shown in FIG. 4. The forward end of each of the longitudinal leg straps 48 is tightened with respect to each of the diagonal straps 52 by pulling the leg straps through buckle 53 until the appropriate 66 inch marking line on the longitudinal leg strap is adjacent that buckle. Alignment strap 30*a* is then removed from pin buckle 32*b* by disengaging the connection of pin 34 in aperture 44 and by pulling the strap out. Alignment strap 30*a* is passed across the rear of the animal and is engaged with the rearwardly extending slotted buckle on transverse strap 18*d*, as shown in FIG. 1.

To prevent webbing 20 from contacting the udder of this smaller animal, the webbing is doubled back over itself as shown in FIG. 4. This is done by disengaging transverse strap 18*a* from slotted buckle 26 on each side of the sling, and then by doubling the webbing over itself and engaging buckle 51, also as shown in FIG. 4. For even smaller cows and smaller livestock such as sheep and goats, webbing 20 is maintained in this doubled-over condition. Each of the longitudinal leg straps 48 may be further tightened with respect to each diagonal strap 52 as necessary to the appropriate marking on the longitudinal leg straps. The rear end of each longitudinal leg strap may be mounted to transverse strap 18*a*, *b* or *c* to fit the animal being hoisted.

Once the sling 10 is fitted to the size of the animal being hoisted, the sling may be slid under the downed animal and the animal's legs should be passed through front leg openings 24 and rear leg openings 50. The transverse rods 58 and the associated hardware is then mounted to poles 12 and to the load lifting means 72, and the animal is slowly raised off the ground.

Because the animal is stable in this position, it may be transported from a distant field back to the barn or other housing facility. Because the weight of the animal 22 is evenly distributed, it may be maintained in an elevated condition for extended periods of time without discomfort or injury to the animal. Once the animal is healed, it may be slowly lowered to the ground, with the legs bearing at first a small part of the weight of the animal, with this amount being increased on a regular basis until the animal is ready to support its weight. If the sling 10 is being used for artificial insemination or birthing, the rear end of the animal may be elevated with respect to the front end for easier access.

To release the animal 22 from the sling 10, the animal is first lowered to the ground and the two sling mounting members 54 and 56 are disconnected from eyelets 14. This permits the sling to drop to the ground, permitting the animal to merely walk out of it.

Figure 7:
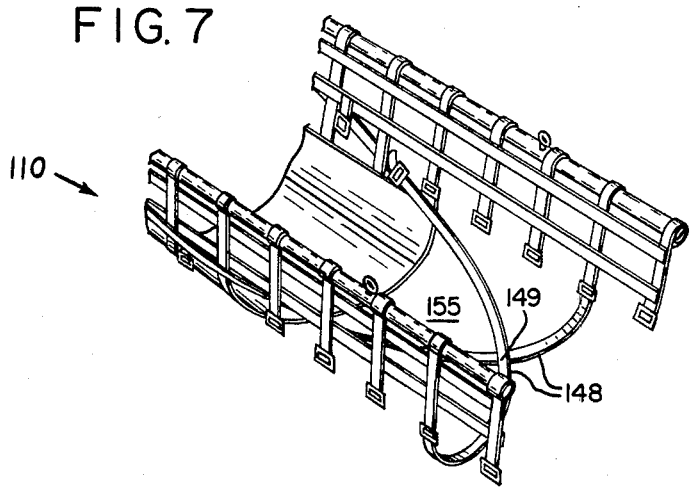
FIG. 7 is a fragmentary perspective view of a second embodiment of the invention, showing crossed longitudinal leg straps.

The Embodiment of FIG. 7

The embodiment of FIG. 7 is identical in all respects to sling 10 depicted in FIGS. 1–6 except for the rearward portion. Because of the similarity, this embodiment will only be briefly described and has been only fragmentarily depicted. Components of this second preferred embodiment have been identified with corresponding numerals in the 100 series. This embodiment of the sling has therefore been generally identified with the numeral 110.

The basic difference between the slings of the first and second embodiments is that the longitudinal leg straps 148 of sling 110 cross each other, thereby deleting the need for a cross piece such as 49. Like cross piece 49 of sling 10, the rearward end of the udder/genital opening 155 is defined by the point 149 at which the longitudinal leg straps cross. The crossing of longitudinal leg straps 148 replaces the need for a strap extending around the rear of the animal. Therefore, the second alignment straps 30*a* and *b* can be fixed to transverse straps 18*d* and *e*, and pin buckles 32*a* and *b* are rendered unnecessary. In all other respects, the two slings are identical.

FIG. 7 shows longitudinal leg straps 148 attached to the second from the last transverse straps 18*d* to accommodate a medium size cow. To adjust sling 110 for a larger or smaller animal, the longitudinal leg straps 148 are simply shifted forwardly or rearwardly to one of the other transverse straps 118*a, b, c* or *e*. For this reason, the design of sling 110 is actually preferable to that of sling 10.

It should be understood that various changes and modifications to the preferred embodiment described herein will be apparent to those skilled in the art. These and other changes and modifications can be made without departing from the spirit and scope of the present invention and without diminishing its attendant advantages. It is, therefore, intended that such changes and modifications be covered by the following claims.

It is claimed and desired to secure by Letters Patent:

1. A sling for supporting a four-legged animal, the sling having a pair of poles with front and rear ends, the sling further having two sides and comprising:

a plurality of longitudinally spaced, transversely extending straps adapted to extend between the poles;

web means extending between forward ones of said transverse straps for supporting the belly of the animal and defining a forward end of an udder/-genital opening;

a pair of diagonal straps, one of which extends generally forwardly and upwardly on each side of the sling and which is affixed to a plurality of said transverse straps;

a pair of generally longitudinally extending leg straps mounted between the rearward ends of said diagonal straps and rearward ones of said transverse straps, said longitudinal leg straps crossing the underside of the animal to define the rearward end of said udder/genital opening.

2. The sling of claim 1, further comprising a cross strap extending between said longitudinal leg straps rearwardly of said udder/genital opening.

3. A sling for supporting a four-legged animal comprising:

a pair of longitudinally extending poles having front and rear ends;

a plurality of longitudinally spaced, transversely extending straps mounted between said poles;

centrally disposed web means extending between forward ones of said transverse straps for supporting the belly of the animal; and a pair of generally longitudinally extending leg straps which extend from forward ones of said transverse straps and cross each other to define an udder/-genital opening therebetween and are connected to said poles by opposite ones of said rearward transverse straps, said transverse and longitudinal leg straps and said web means collectively defining four leg openings, each of said longitudinal leg straps further being removably connected to one of said rearward transverse straps whereby the effective size of the sling may be adjusted by connecting said longitudinal leg straps to different ones of said rearward transverse straps.

4. The sling of claim 3 wherein downwardly extending releasable mounting means is provided for each side of the sling, disposed forwardly and above the rearward end of said web means, and the rear-most pair of said transverse straps to which said web means is mounted is provided with disconnect means for breaking said rear-most transverse straps into upper and lower portions so that said web means is adapted to be doubled back and said lower portion of each of said rear-most transverse straps can be connected to one of said releasable mounting means, thereby shortening said web means to adapt the sling for smaller animals.

5. The sling of claim 4 wherein the front end of each of said longitudinal leg straps is mounted to said poles by a diagonal strap extending generally forwardly and diagonally upwardly, and one of said releasable mounting means is mounted to each said diagonal strap.

6. A sling for supporting a four-legged animal comprising:

a pair of longitudinally extending poles having front and rear ends;

a plurality of longitudinally spaced, transversely extending straps mounted between said poles;

centrally disposed web means extending between forward ones of said transverse straps for supporting the belly of the animal;

a pair of generally longitudinally extending leg straps mounted between at least some of said transverse straps, the rear end of each of said longitudinal leg straps being mounted to said poles by being removably connected to one of said rearward transverse straps whereby the effective size of the sling may be adjusted by connecting said longitudinal leg straps to different ones of said rearward transverse straps, said transverse and longitudinal leg straps and said web means collectively defining four leg openings and an udder/genital opening; and longitudinally extending alignment straps mounted between said transverse straps, at least one of said alignment straps being mounted to the rearmost transverse strap on each side of the sling by removable mounting means and extending around the rear of the animal.

7. The sling of claim 6 wherein said removable mounting means comprises a buckle mounted to said rearmost transverse strap on one side of the sling, said buckle having a centrally disposed, rigid pin extending perpendicularly therefrom, one of said alignment straps being adapted to pass through said buckle and defining a hole to receive said pin to rigidly but removably fix said rearmost transverse strap and said alignment strap with respect to each other.

8. The sling of claim 7, further comprising means for mounting the sling to a load lifting means for supporting and lifting said poles in a generally horizontal disposition.

9. The sling of claim 8 wherein downwardly extending releasable mounting means is provided for each side of the sling, disposed forwardly and above the rearward end of said web means, and the rear-most pair of said transverse straps to which said web means is mounted is provided with disconnect means for breaking said rear-most transverse straps into upper and lower portions so that said web means can be doubled back and said lower portion of each of said rear-most transverse straps can be connected to one of said releasable mounting means, thereby shortening said web means to adapt the sling for smaller animals.

10. The sling of claim 9 wherein the front end of each of said longitudinal leg straps is mounted to said poles by a diagonal strap extending generally forwardly and diagonally upwardly, and one of said releasable mounting means is mounted to each said diagonal strap.

11. A sling for supporting a four-legged animal comprising:

a pair of longitudinally extending poles having front and rear ends;

a plurality of longitudinally spaced, transversely extending straps mounted between said poles;

a centrally disposed web means extending between at least some of said transverse straps for supporting the belly of the animal;

a pair of generally longitudinally extending leg straps extending between at least some of said transverse straps, said transverse and longitudinal leg straps and said web means collectively defining four leg openings and an udder/genital opening;

rear retention means extending transversely from side to side of the sling around the rear of the animal; and downwardly extending releasable mounting means provided for each side of the sling, disposed forwardly and above the rearward end of said web means, and wherein the rearmost pair of said transverse straps to which said web means is mounted is provided with disconnect means for breaking said rearmost transverse straps into upper and lower portions so that said web means is adapted to be doubled back and said lower portion of each of said rear-most transverse straps can be connected to one of said releasable mounting means thereby shortening said web means to adapt the sling for smaller animals.

* * * * *